US005255322A

United States Patent [19]

Farinelli et al.

[11] Patent Number: 5,255,322

[45] Date of Patent: Oct. 19, 1993

[54] MULTI-ZONE AUDIO DISTRIBUTION AMPLIFIER

[75] Inventors: Robert P. Farinelli, Lexington, Ky.; Shelton R. Rose, Brentwood; Michael Morgan, Nashville, both of Tenn.

[73] Assignee: Square D Co., Palatine, Ill.

[21] Appl. No.: 819,087

[22] Filed: Jan. 9, 1992

[51] Int. Cl.[5] ..... H04R 27/00

[52] U.S. Cl. ..... 381/84; 381/77; 381/81; 361/729; 361/730; 361/736

[58] Field of Search ..... 381/77, 82, 84, 85, 381/28, 120, 80, 81; 361/393, 394, 395, 396

[56] References Cited

U.S. PATENT DOCUMENTS

| | | | |
|---|---|---|---|
| 4,481,661 | 11/1984 | Spector | 381/85 |
| 4,953,058 | 8/1990 | Harris | 361/396 |
| 5,043,847 | 8/1991 | Deinhardt et al. | 361/395 |
| 5,130,662 | 7/1992 | Jorgensen et al. | 381/81 |

OTHER PUBLICATIONS

SSI Products, Inc.—SSI Powerflex V.

Audio Design Associates, Inc.—Preliminary Dealer Release Ads—The Evolution of Titanus THX Power.

*Primary Examiner*—Jin F. Ng
*Assistant Examiner*—Edward Lefkowitz
*Attorney, Agent, or Firm*—Larry I. Golden; Kareem M. Irfan

[57] ABSTRACT

A multi-zone audio distribution amplifier system includes positions for several stereo amplifiers which may be used as modular and cascadable amplifier units. The system is enclosed in a housing having a front panel with windows for exposing a set of led display circuits on the front side of the housing and easy access to the modular units on the rear side of the housing. Each modular amplifier unit includes a printed circuit board for an amplification circuit, a heat sink, and a loop-back port for cascading the amplifier units. An interface board includes support for the display and edge-connector receptacles for receiving each printed circuit board edge and for providing power to each of the amplifier units. Each amplifier unit is operable independent of the others, and the desired amplification may be selected by electrically cascading the amplifier units via the loop-back ports.

20 Claims, 6 Drawing Sheets

MULTI-ZONE AUDIO DISTRIBUTION AMPLIFIER

FIELD OF THE INVENTION

The present invention relates generally to audio distribution systems and, more particularly, to audio distribution system amplifier arrangements.

BACKGROUND OF THE INVENTION

Home owners are rapidly becoming aware of the benefits of home audio distribution systems. These benefits include convenient access to audio signals throughout the home, more efficient use of space, and savings in the form of reduced equipment need due to better utilization of existing equipment.

Audio distribution systems range from those distributing mono signals only, such as doorbell and intercom signals, to those incorporating a selective mixture of stereo signals and such mono signals. Certain of these systems utilize a switching matrix to distribute various input signals to various rooms throughout the house. Speakers in the various rooms typically receive the amplified signal through a distribution panel located in the room.

Other prior art systems require purchase of a separate amplifier unit to distribute each type of signal.

Another type of audio distribution system includes multiple level-adjustable mono amplifiers in a single enclosure, with the multiple amplifiers providing parallel mono channels to serve different types of input signals. This type of system requires that the system enclosure be diassembled in order to expand the system with additional amplifiers.

These types of prior art systems, unfortunately, have several setbacks. Prior art systems using a switching matrix to distribute various input signals are unable to accommodate significant differences in input level between the various input signals. With respect to those systems requiring separate amplifier units, space requirements and cost make it burdensome for users to add audio components which also require amplification by the system. Systems using multiple level-adjustable mono amplifiers in a single enclosure are expensive because they do not provide user-friendly modularity, they are unable to serve a wide range of signal types, and their input level adjustability range is unduly limited.

Accordingly, there is a need for an improved audio distribution system that overcomes the aforementioned shortcomings.

SUMMARY OF THE INVENTION

It is a general object of the present invention to provide a multi-zone audio distribution system, which is able to separately amplify mono and stereo signals in a space-effective and cost-effective manner.

It is another important object of the present invention to provide a multi-zone modular audio distribution system that includes multiple level-adjustable stereo amplifiers arranged in parallel to serve different types of audio input signals.

It is yet another important object of the present invention to provide a multi-zone modular audio distribution system that includes multiple level-adjustable stereo amplifiers, each having circuitry for cascading the various amplifiers.

In a preferred embodiment, these and other objects of the present invention are realized using an audio distribution amplifier system, which includes a housing having a first side and a second side, a plurality of amplifier units, and an interface board including edge-connector means for providing power to each of the plurality of amplifier units. Each amplifier unit includes an input port for receiving an input stereo signal, at least one amplification circuit which amplifies the input stereo signal, an output port for providing access to the input stereo signal amplified by a preselected amplification factor, a printed circuit board having a face upon which the amplification circuit is mounted and having interface and side edges, and a port panel that is connected to the printed circuit board and that is secured within the housing and adjacent its second side. The amplifier units are modularly adaptable to the system such that each amplifier unit is operable independent of each other amplifier unit and is accessible via the second side at a position which receives the port panel.

Preferably, the system includes printed circuit board guides for guiding each of the amplifier units along the side edges to mate with the interface board, and each amplifier unit further includes a loop-back port for cascading at least two of the amplifier units. The amplification circuit may include a heat sink thermally coupled thereto and a polyswitch arranged as a thermal shutback device for interrupting power to the amplification circuit under undesired thermal conditions.

BRIEF DESCRIPTION OF THE DRAWINGS

Other objects and advantages of the invention will become apparent upon reading the following detailed description and upon reference to the drawings in which.

Figure 1A:
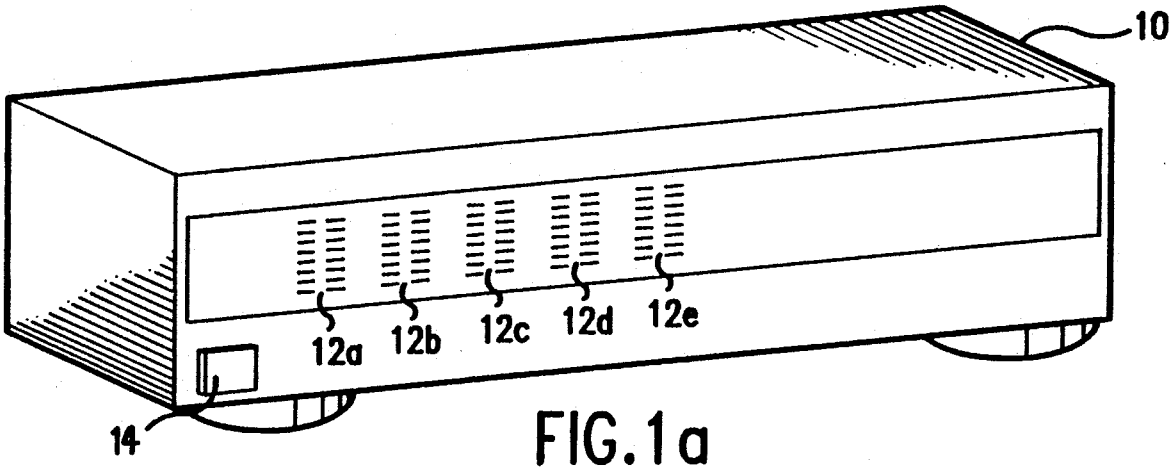
FIG. 1*a* is a perspective diagram of a multi-zone audio distribution amplifier system within an exemplary enclosure, according to the present invention.

While the invention is susceptible to various modifications and alternative forms, a specific embodiment thereof have been shown by way of example in the drawings and will be described in detail. It should be understood, however, that the illustrated embodiment is not intended to limit the invention to the particular form described. On the contrary, the intention is to cover all modifications, equivalents, and alternatives falling within the spirit and scope of the invention as defined by the appended claims.

DESCRIPTION OF THE PREFERRED EMBODIMENT

The present invention is directed to the implementation of multiple modularly cascadable amplifiers in a single conventionally sized (or racked) unit. The intended applications include a wide variety of industrial, commercial and consumer uses. For instance, the present invention is ideally suited for consumer applications which require amplification of different types of audio signals (e.g., stereo from the television and from the radio, door bell, intercom, etc.) at a central location. Other features such as cascadability of the amplifiers and modularity (both of which will be discussed herein) offer a range of uses not heretofore known.

Figure 1B:
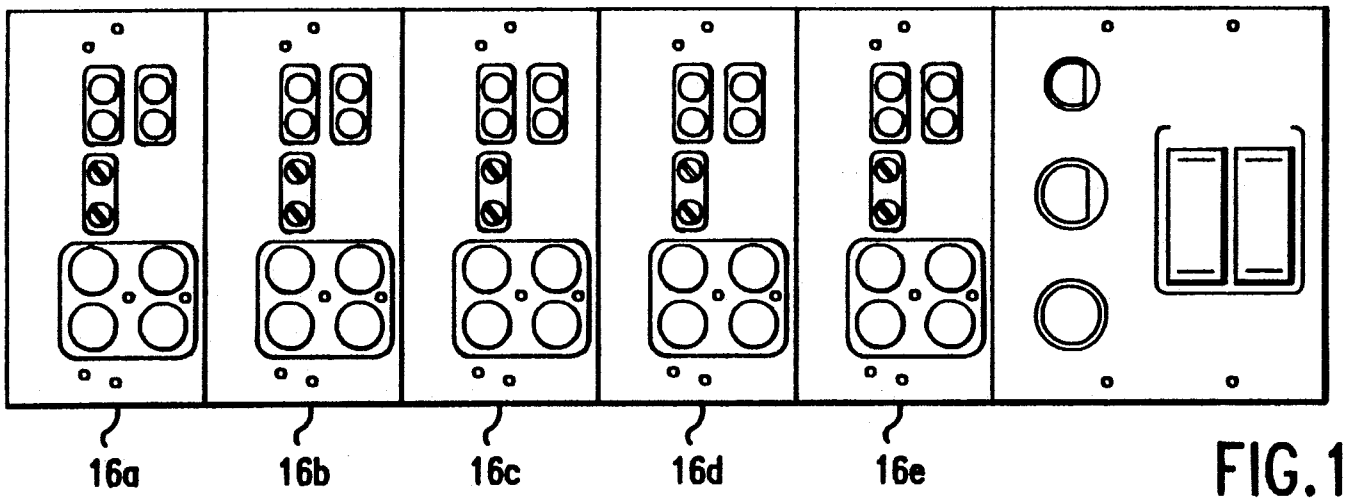
FIG. 1*b* is an illustration of the multi-zone audio distribution amplifier system of FIG. 1*a* from the rear side.

FIG. 1*a* illustrates the present invention, as enclosed in a housing 10 with the front side of the housing showing five pairs of LED (light emitting diode) bar graphs 12*a*, 12*b*, 12*c*, 12*d* and 12*e*. An on/off switch 14 is shown in the lower left corner of the front side. The rear side of the housing is shown in FIG. 1*b* as having five identical modular back panels 16*a*, 16*b*, 16*c*, 16*d* and 16*e*, one for each respective bar graph pair 12*a*–12*e*, and a power supply panel 18.

The modularity of the system is highly advantageous from both cost and convenience perspectives. With respect to cost, the "growability" of the system permits its user to purchase the system with a single amplifier card at a substantially reduced cost, and later purchase one or more additional cards for further amplification requirements as the desired audio uses grow and/or change. From a convenience perspective, the system is designed to allow its user to remove and insert individual amplifier cards via access of only two screws, which are located at the back of the housing for each back plane (see screw holes 19*a* and 19*b* of FIG. 1*c*).

Figure 1C:
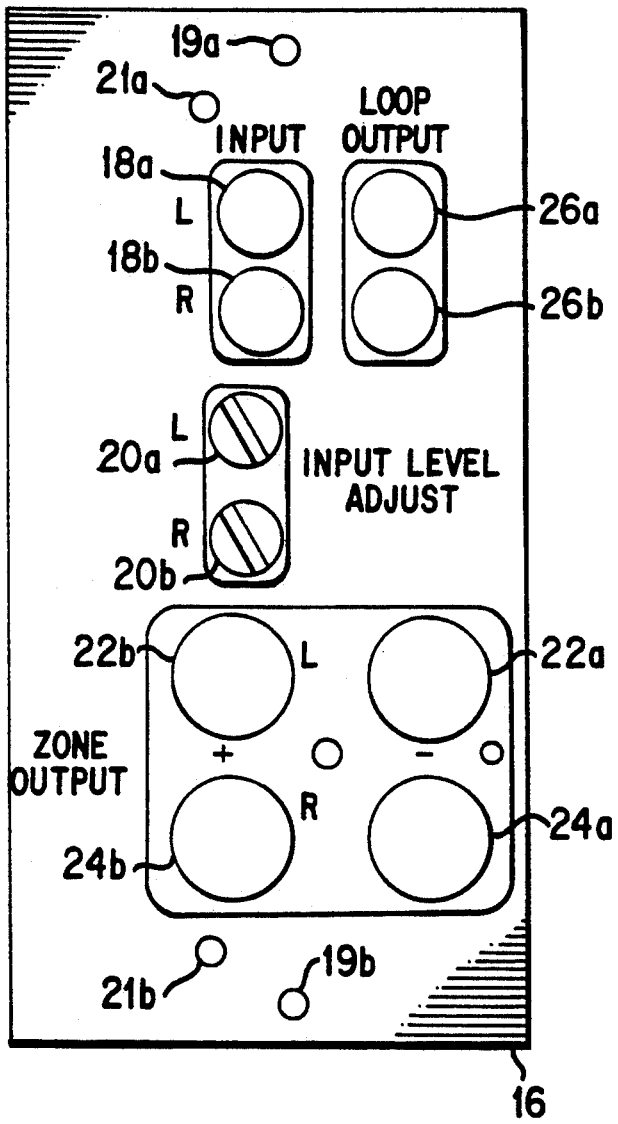
FIG. 1*c* is an expanded illustration of one of several back panels shown in FIG. 1*b;*

In FIG. 1*c*, each back panel 16 is illustrated as including left and right input ports 18*a* and 18*b*, and input level-adjust controls 20*a* and 20*b* for the respective left and right input channels.

As an output, the back panel 16 includes a pair of ports for each of the left and right channels. For the left output channel, negative and positive ports are depicted as 22*a* and 22*b*; and for the right output channel, negative and positive ports are depicted as 24*a* and 24*b*.

Another important aspect of the present invention involves a pair of loop output ports 26*a* and 26*b* of FIG. 1*c*. These ports provide the user with the capability of cascading the amplifier blocks associated with each modular back panel 16. For example, in a system using only four of the five modular positions, one of the positions may be used in a dedicated manner to amplify a separate audio signal, while the remaining three positions may be used in a cascaded manner to amplify another audio signal three times (once at each position). In applications requiring amplification of relatively low signal levels, this feature alleviates the need for a custom-designed amplification circuit and, in combination with the input level-adjust controls 20*a* and 20*b*, provides the user with wide-range and narrow-range amplification control.

Figure 2:
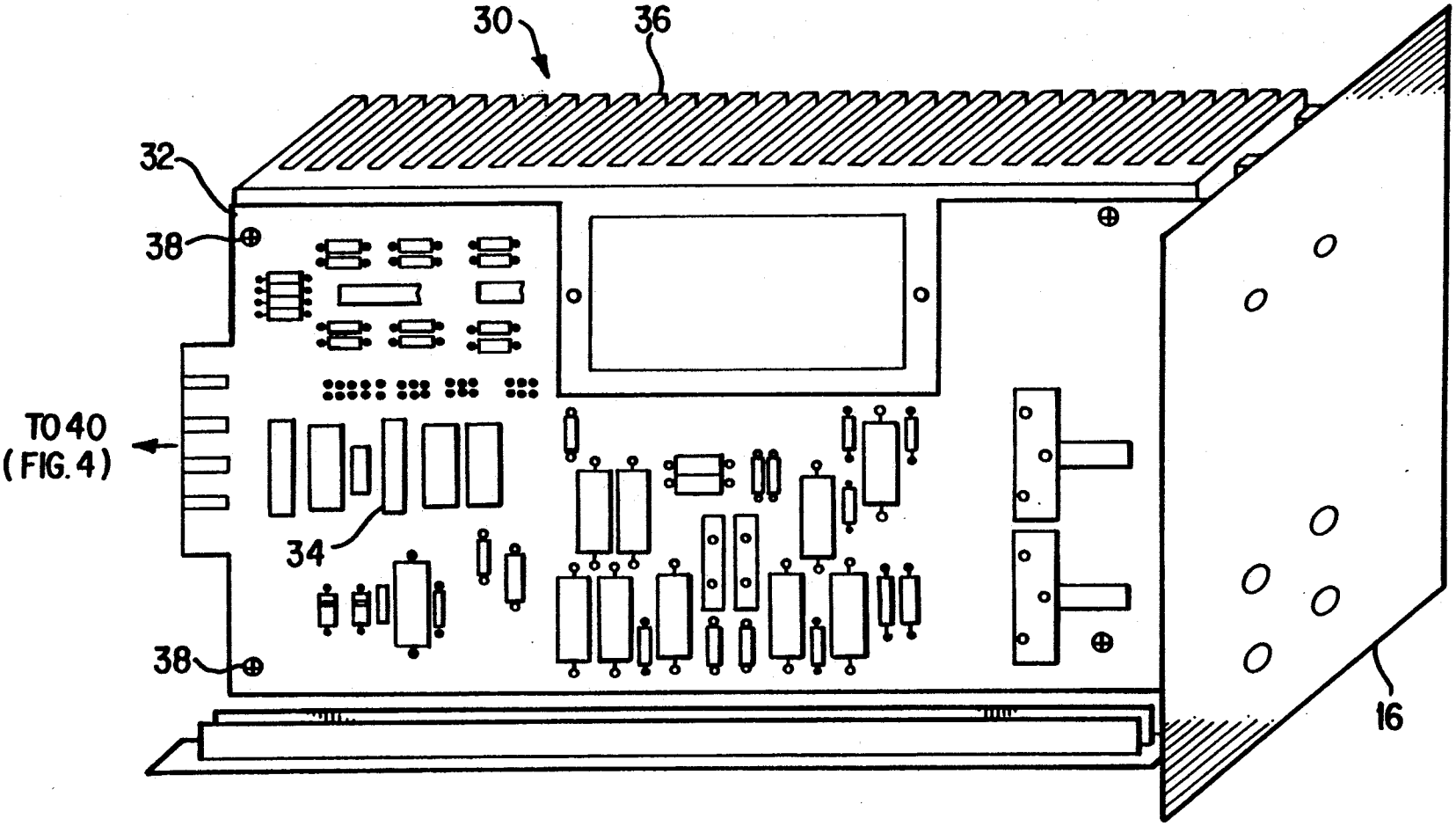
FIG. 2 is perspective diagram of a modular amplifier card (with attached back panel), which inserts into the rear side of the enclosure shown in FIG. 1*a;*

FIG. 2 illustrates the back panel 16 connected to an amplifier card 30. The amplifier card 30 includes a printed circuit board 32, with various amplifier components 34 thereon, and an air-cooled finned heat sink 36 attached to the circuit board 32 via bolts 38. The heat sink 36 is used to dissipate heat from the amplifier chip, discussed infra in connection with FIG. 3.

Figure 4:
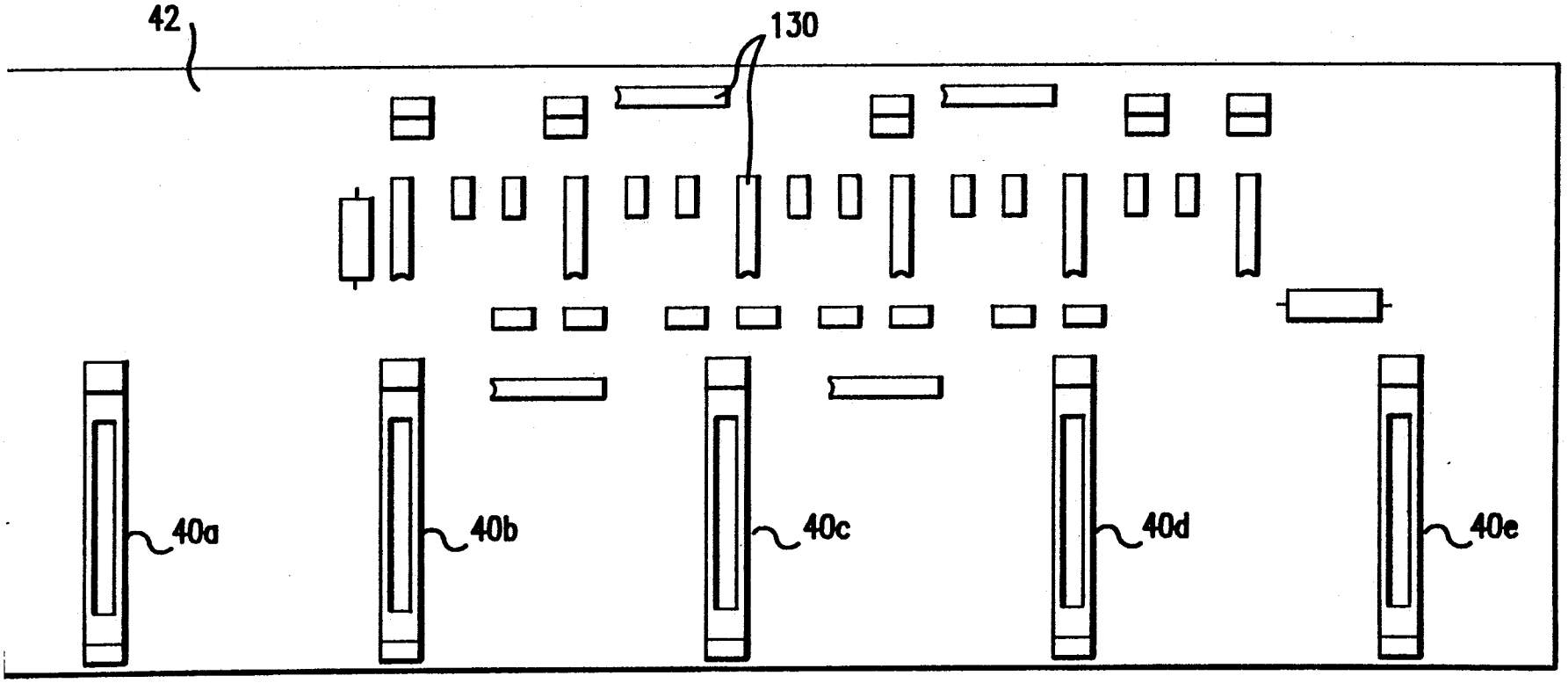
FIG. 4 is a diagram of an interface board, according to the present invention, into which each one of the amplifier circuits of FIG. 2 connects.

Also shown in FIG. 2 is one of two conventional printed circuit board guides which are used to slidably guide the amplifier card 30 into one of the female receptacles 40*a*–40*e* of the interface board 42 of FIG. 4.

One of the amplifier cards is added to the system by first removing a dummy back panel (not shown) from the rear side of the housing, and then sliding an amplifier card along the guides into the associated female receptacle (40*a*–40*e*). The back panel 16 is secured to the printed circuit board 32 via conventional printed circuit board mounting brackets (attached via screw holes 19*a* and 19*b*). The final step is securing the back panel 16 to the housing 20 using screws which are inserted through holes 21*a* and 21*b* in the back panel 16.

Figure 3:
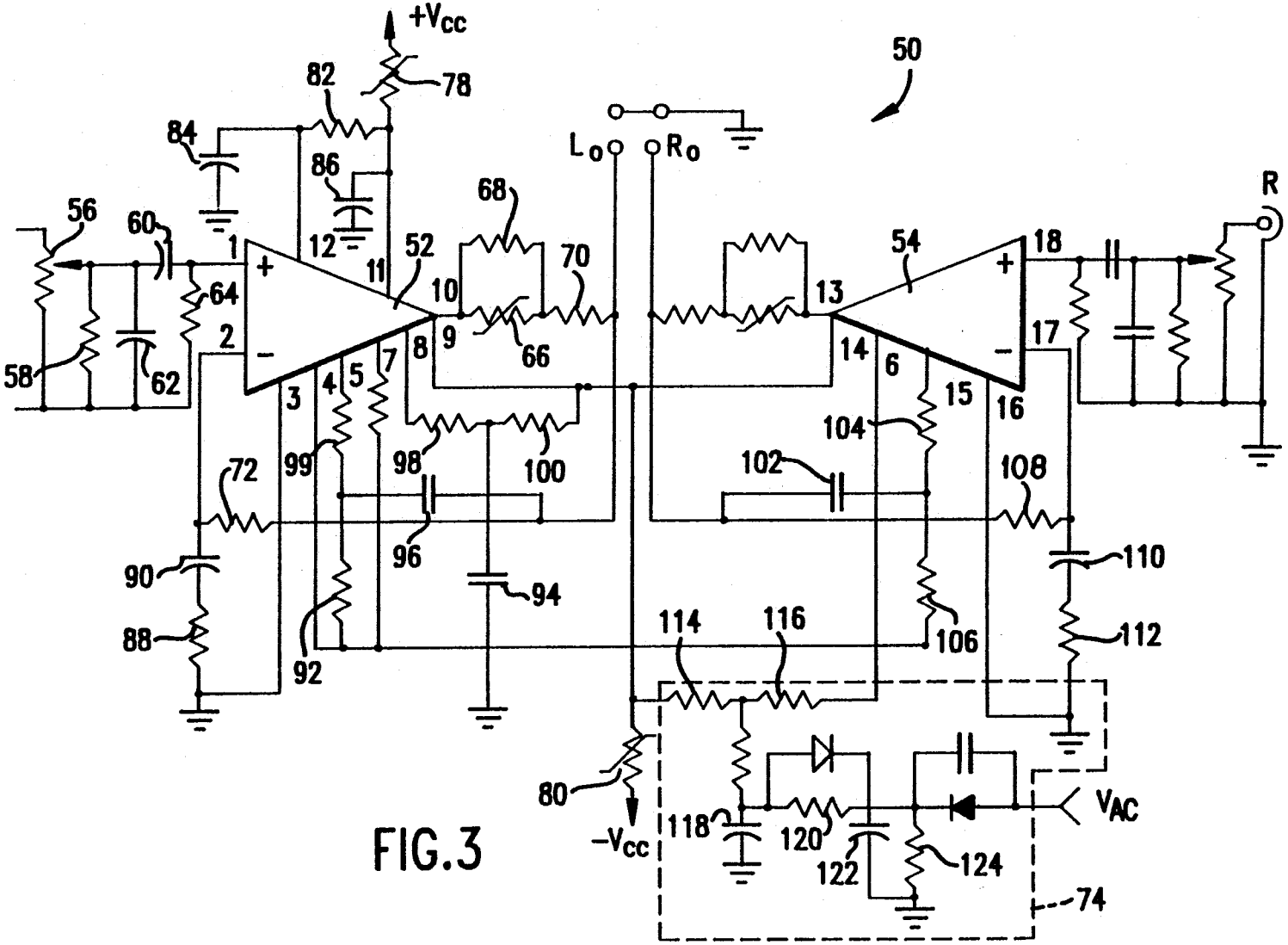
FIG. 3 is a circuit diagram illustrating a preferred implementation of one of the amplifier circuits represented by the amplifier card of FIG. 2.

A preferred implementation of each identical amplifier circuit 50 is shown in FIG. 3. The circuit of FIG. 3 includes left and right inputs L and R, and corresponding outputs Lo and Ro, respectively. The input and output circuitry is coupled to left and right operational amplifiers 52 and 54. The loop-back ports of FIG. 1*b* are connected to the inputs of the circuit 50. Because of the similarity of the input and output circuitry coupled to each of the amplifiers 52 and 54, only the input and output circuitry coupled to the left amplifier 52 will be discussed.

Beginning at the left side of the schematic, the left-channel input signal is fed through an input level-adjust potentiometer 56 and divider resistor 58. The input level-adjust potentiometer 56 is user-controlled by the level-adjust control 20*a* of FIG. 1*c*. Capacitors 60 and 62 and resistor 64 provide proper AC coupling to the amplifier 52. The output of the amplifier 52 is connected to a short circuit protection circuit, which includes an (amplifier) output protection resistor 70 in series with the parallel combination of polyswitch 66 and resistor 68. The Lo output signal is taken from the right side of the output protection resistor 70.

The factor of amplification provided by the amplifier 52 is determined by the value of the feedback resistor 72. The other circuitry surrounding the feedback resistor 72 is provided for the internal requirements of the Sanyo STK4192 chip, which is preferably used to implement the amplifiers 52 and 54.

The AC power to the circuit 50 is provided from a power transformer (not shown) via the circuitry 74 in dotted lines.

For further information concerning the theory of operation of this circuitry, reference should be made to the Sanyo data book for part number STK4192.

One aspect of this circuit that is not referred to in the above-referenced data book is the thermal protection circuit surrounding polyswitches 78 and 80. Each of these polyswitches is used to provide the function of a crowbar circuit to interrupt power to the amplifiers 52 and 54 in the event that the ambient temperature exceeds specification. In a preferred embodiment in which thermal shutdown is provided at 150 degrees Fahrenheit, +Vcc is 33 Vdc, −Vcc is −33 Vdc, resistor 82 is 100 Ohms, capacitor 84 is 100 microfarads, capacitor 86 is 10 microfarads, and the polyswitches 78 and 80 are implemented using Polly Switch PTC resistor type parts (available from Raytheon).

The remaining component values used for the circuit 50 are listed below. The prefixes "R" and "C" are used to identify the respective resistors and capacitors depicted in the illustrated schematic. These component values are as follows (in Ohms and farads):

| | |
|---|---|
| R56 = 100 k | R58 = 10 k |
| C60 = 2.2 micro | C62 = 470 pico |
| R64 = 49.9 k | R68 = 1k |
| R70 = 0.22 | R72 = 49.9 k |
| R82 = 100 | C84 = 100 micro |
| C86 = 10 micro | R88 = 499 |
| C90 = 100 micro | R92 = 3.3 k (½ Watt) |
| C94 = 10 micro | C96 = 47 micro |
| R98 = 1 k (½ Watt) | R99 = 3.3 k (½ Watt) |
| R100 = 1 k (½ Watt) | C102 = 47 micro |
| R104 = 3.3 k (½ Watt) | R106 = 3.3 k (½ Watt) |
| R108 = 49.9 k | C110 = 100 micro |
| R112 = 499 | R114 = 100 k |
| R116 = 10 k | C118 = 47 micro |
| R120 = 4.7 k | C122 = 47 micro |
| R124 = 1 k (½ Watt) | |

Referring now to the interface board 42 of FIG. 4, in addition to the female receptacles 40a–40e, the interface board 42 carries conventional circuitry 130 for the led bar graphs and carries power from the power supply module to each of the amplifier boards. Power is provided via printed circuits on the mother board from the power supply module to each of the female receptacles 40a–40e. This power includes each of the Vcc, ground and AC signals illustrated and discussed in connection with FIG. 3.

Figure 5:
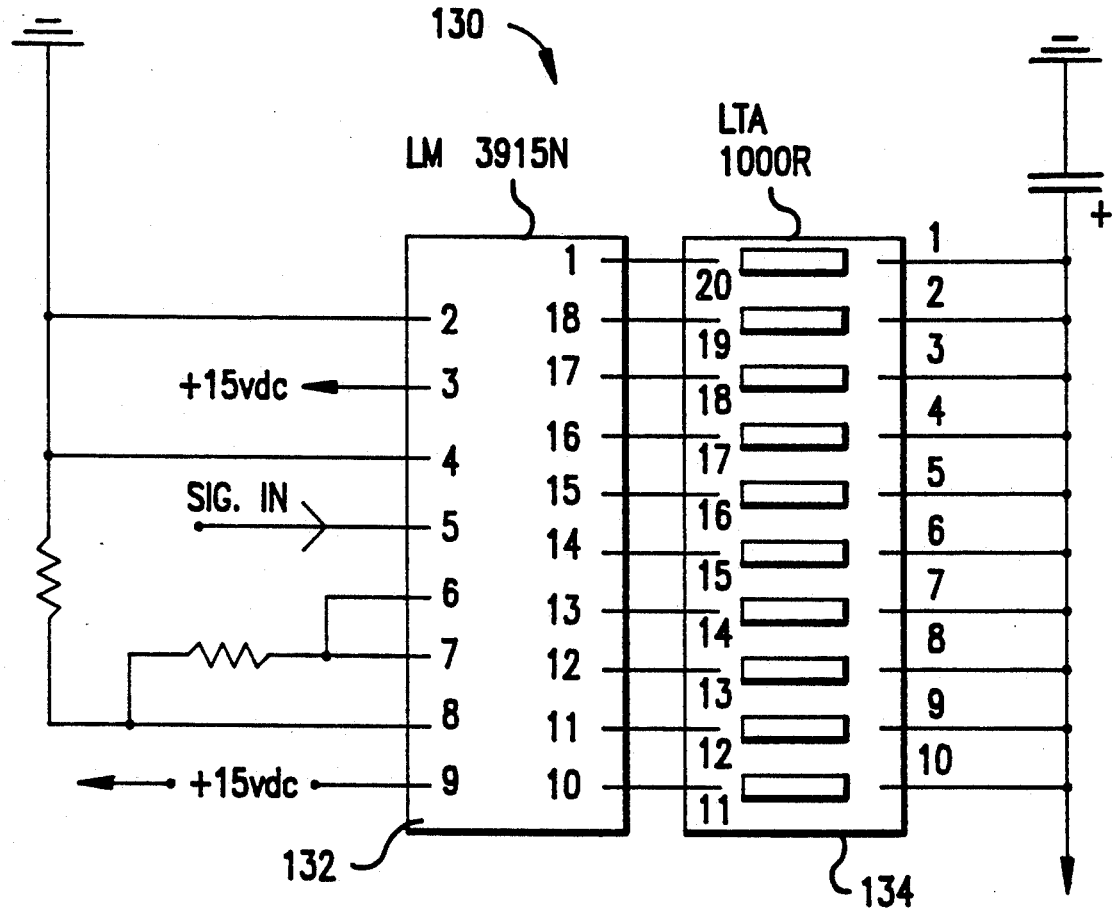
FIG. 5 is a circuit diagram, also in accordance with the present invention, of one of the displays shown in FIG. 1*a*.

FIG. 5 illustrates the led bar graph circuitry 130, which includes an LM3915N type display driver 132 and an LTA1000R type led bar graph display 134. The input signal to the bar graph is taken from the respective left channel or right channel input of the circuit of FIG. 3, via a 10 kOhm resistor (not shown).

Accordingly, the present invention provides a cost-effective and user-friendly modular amplifier system for a multi-zone audio distribution application. While the inventive system has been particularly shown and described with reference to certain embodiments, it will be recognized by those skilled in the art that modifications and changes may be made to the present invention described above without departing from the spirit and scope thereof.

What is claimed is:

1. An audio distribution amplifier system, comprising:

a housing having a first side and a second side;

a plurality of amplifier units, each unit including an input port for receiving an input stereo signal, at least one amplification circuit which amplifies the input stereo signal, an output port for providing access to the input stereo signal amplified by a preselected amplification factor, a printed circuit board having a surface upon which the amplification circuit is mounted and having interface and side edges, and a port panel that is connected to the printed circuit board and that is secured adjacent the second side of the housing;

an interface board including edge-connector means for providing power to each of the plurality of amplifier units; and means, located adjacent the second side of the housing, for securing the amplifier unit within the housing;

wherein the amplifier units are modularly adaptable to the system such that each amplifier unit is operable independent of each other amplifier unit and is accessible via the second side at a position which receives the port panel.

2. An audio distribution amplifier system, according to claim 1, further including a guide means, attached to the housing, for guiding one of the amplifier units along said side edges.

3. An audio distribution amplifier system, according to claim 2, wherein each amplifier unit further includes a loop-back port for cascading at least two of said plurality of amplifier units.

4. An audio distribution amplifier system, according to claim 3, wherein said amplification circuit includes a loop-port output which is coupled to said loop-back port.

5. An audio distribution amplifier system, according to claim 3, wherein said loop-back port is located on said port panel of the amplifier unit.

6. An audio distribution amplifier system, according to claim 1, wherein said amplification factor is designated by feedback circuitry in said amplification circuit.

7. An audio distribution amplifier system, according to claim 1, wherein said amplification circuit includes a heat sink and thermal shut-back means for disabling said amplification circuit under undesired thermal conditions.

8. An audio distribution amplifier system, according to claim 7, wherein said thermal shut-back means includes a polyswitch which interrupts power from the interface board under said undesired thermal conditions.

9. A multi-zone audio distribution amplifier system, comprising:

at least one display circuit;

a housing having a front panel with means for exposing the display circuit, a rear side and four side walls;

a plurality of amplifier units, each unit including an input port for receiving an input stereo signal, at least one amplification circuit which amplifies the input stereo signal, an output port for providing the input stereo signal amplified by a preselected amplification factor to a respective zone, a printed circuit board having a surface upon which the amplification circuit is mounted and having interface and side edges, and a port panel that is connected to the printed circuit board and that is secured adjacent the rear side of the housing, such that the plurality of port panels cover a substantial portion of the rear side;

an interface board including support for said display means and including edge-connector means for providing power to each of the plurality of amplifier units; and means, located adjacent the rear side of the housing, for securing the amplifier unit within the housing;

wherein the amplifier units are modularly adaptable to the system such that each amplifier unit is operable independent of each other amplifier unit and is accessible via the second side at a position which receives the port panel.

10. A multi-zone audio distribution amplifier system, according to claim 9, wherein said input port includes means for connecting a pair of balanced signals and said output port includes positive and negative terminals for a left output channel and for a right output channel.

11. A multi-zone audio distribution amplifier system, according to claim 10, wherein each amplifier unit further includes a loop-back port for cascading at least two of said plurality of amplifier units.

12. A multi-zone audio distribution amplifier system, according to claim 9, wherein each amplifier unit further includes a loop-back port for cascading at least two of said plurality of amplifier units.

13. A multi-zone audio distribution amplifier system, according to claim 12, wherein said amplification factor is designated by feedback circuitry in said amplification circuit.

14. A multi-zone audio distribution amplifier system, according to claim 13, wherein said amplification circuit includes thermal shut-back means for disabling said amplification circuit under undesired thermal conditions.

15. A multi-zone audio distribution amplifier system, according to claim 14, wherein said thermal shut-back means includes a polyswitch which interrupts power from the interface board under said undesired thermal conditions.

16. A multi-zone audio distribution amplifier system, comprising:

a plurality of led display circuits;

a housing having a front panel with means for exposing each display circuit, a rear side and four side walls;

a plurality of amplifier units, each unit including an input port for receiving an input stereo signal, at least one amplification circuit which amplifies the input stereo signal, an output port for providing the input stereo signal amplified by a preselected amplification factor to a respective zone, a printed circuit board having a surface upon which the amplification circuit is mounted and having interface and side edges, a heat sink that is thermally coupled to the printed circuit board, a port panel that is connected to the printed circuit board and that is secured adjacent the rear side of the housing such that the plurality of port panels cover a substantial portion of the rear side, means for providing a signal to drive an associated one of display circuits, and a loop-back port for cascading at least two of said plurality of amplifier units;

an interface board including support for said display means and including edge-connector means for providing power to each of the plurality of amplifier units; and means, located adjacent the rear side of the housing, for securing the amplifier unit within the housing;

wherein the amplifier units are modularly adaptable to the system such that each amplifier unit is operable independent of each other amplifier unit and is accessible via the second side at a position which receives the port panel and a system user selects the desired amplification by electrically cascading the amplifier units via the loop-back ports.

17. A multi-zone audio distribution amplifier system, according to claim 16, wherein the interface board includes a plurality of female receptacles for receiving the respective edges of each printed circuit board of the amplifier unit.

18. A multi-zone audio distribution amplifier system, according to claim 17, further including at least one a printed circuit board guide for guiding each printed circuit board into one of the female receptacles of the interface board.

19. A multi-zone audio distribution amplifier system, according to claim 18, wherein said led display circuit includes a bar-graph display format.

20. A multi-zone audio distribution amplifier system, according to claim 16, wherein said amplification circuit includes a polyswitch for disabling said amplification circuit under undesired thermal conditions.

* * * * *